US011737634B1

(12) United States Patent
Gele

(10) Patent No.: US 11,737,634 B1
(45) Date of Patent: Aug. 29, 2023

(54) GROUT AND SURFACE CLEANING APPARATUS

(71) Applicant: Richard G. Gele, Bradenton, FL (US)

(72) Inventor: Richard G. Gele, Bradenton, FL (US)

( * ) Notice: Subject to any disclaimer, the term of this patent is extended or adjusted under 35 U.S.C. 154(b) by 132 days.

(21) Appl. No.: 16/901,183

(22) Filed: Jun. 15, 2020

(51) Int. Cl.
*A47L 11/40* (2006.01)

(52) U.S. Cl.
CPC ..... *A47L 11/4044* (2013.01); *A47L 11/4016* (2013.01); *A47L 11/4077* (2013.01); *A47L 11/4088* (2013.01)

(58) Field of Classification Search
CPC ..... A47L 11/201; A47L 11/34; A47L 11/29; A47L 11/4044; A47L 11/4016; A47L 11/4077; A47L 11/4088; A47L 11/26; A47L 11/4036; A47L 9/0606
USPC ..... 15/320
See application file for complete search history.

(56) References Cited

U.S. PATENT DOCUMENTS 3,705,437 A * 12/1972 Rukavina, Jr ..... A47L 11/4088 15/322
4,239,756 A 12/1980 Horrmann
4,333,203 A 6/1982 Yonkers
4,961,244 A * 10/1990 Stanfield ..... A47L 11/4088 15/302
5,127,128 A * 7/1992 Lee ..... A47L 11/4094 15/384
5,465,456 A 11/1995 Fellhauer et al.
5,588,176 A * 12/1996 Sixsmith ..... A47L 1/08 15/360
6,059,475 A 5/2000 Jafarmadar
6,206,980 B1 3/2001 Robinson
7,367,082 B2 5/2008 Gordon et al.
8,365,347 B2 2/2013 Morgan et al.
2005/0060833 A1 3/2005 Guest et al.
2009/0260177 A1 10/2009 Richards
2014/0263707 A1* 9/2014 Zernicke ..... B05B 7/0093 239/452

OTHER PUBLICATIONS

Amazon, https://www.amazon.com/GIBTOOL-Cleaner-Adapter-Conversion-Reducer/dp/B01FHCBV9Y/ref=psdc_510106_t1_B09BYSW17D (Year: 2016).*

* cited by examiner

*Primary Examiner* — Don M Anderson
*Assistant Examiner* — Caleb Andrew Holizna
(74) *Attorney, Agent, or Firm* — Loeffler IP Group, P.A.; Bryan L. Loeffler, Esq.

(57) ABSTRACT

A cleaning apparatus for cleaning grout in tile floors and other surfaces has a proximal end (1) connected to a vacuum source (11) and a high pressure water source (12) activated by a trigger mechanism (13) connected by conduits (6, 8) to a distal end (2) having a cleaning head (7) with nozzle (18) and brush barriers (21, 22) to retain water for conveying by vacuum to the vacuum source.

3 Claims, 5 Drawing Sheets

GROUT AND SURFACE CLEANING APPARATUS

FIELD OF THE INVENTION

This invention relates to cleaning apparatuses and more particularly to a grout and surface cleaning apparatus that is attachable to and is used in conjunction with a high pressure water source, such as a conventional pressure washer, and a vacuum source, such as a wet/dry vacuum.

BACKGROUND OF THE INVENTION

Cleaning surfaces of floors and walls, especially grout between tiles in tile floors, is a labor intensive and relatively expensive process, often with mediocre results at best. To achieve the best results when cleaning such surfaces, the use of water under high pressure is necessary. Unfortunately, water at high pressure can be expelled outside the area being cleaned, thereby making for a messy job and requiring that the water be mopped or vacuumed up.

In view of the above problems, a need exists for a single apparatus that employs both water under high pressure, such as from a conventional pressure washer which almost every household has or can readily obtain, and a vacuum from a vacuum source, such as a conventional wet/dry vacuum which most households also have or can readily obtain, for use in cleaning grout in tile floors and other surfaces.

The relevant prior art includes the following references:

| Pat. No. (U.S. Patent References) | Inventor | Issue/Publication Date |
|---|---|---|
| 4,333,203 | Yonkers | Jun. 8, 1982 |
| 5,465,456 | Fellhauer et al. | Nov. 14, 1995 |
| 6,059,475 | Jafarmadar | May 9, 2000 |
| 6,206,980 | Robinson | Mar. 27, 2001 |
| 2005/0060833 | Guest et al. | Mar. 24, 2005 |
| 4,239,756 | Chicoine et al. | May 18, 1982 |
| 7,367,082 | Gordon et al. | May 6, 2008 |
| 2009/0260177 | Richards | Oct. 22, 2009 |
| 8,365,347 | Morgan et al. | Feb. 5, 2013 |

SUMMARY OF THE INVENTION

The primary object of the present invention is to provide a single apparatus that can clean discolored grout in tile floors and other surfaces of dirt or soiling.

Another object of the present invention is to provide such a device that combines water under high pressure from a high pressure water source and vacuum from a vacuum source to do so.

A further object of the present invention is to provide such an apparatus that accomplishes the above objects that is inexpensive and can be used by any home owner that has access to a pressure washer and a wet/dry vacuum.

The present invention accomplishes the above and other objects by providing a grout and surface cleaning apparatus having a proximal end containing a hand-held activation mechanism, such as a trigger, connected to a high water pressure source and vacuum source and a distal end having a head with a mouth containing a nozzle for expelling water and an inlet for the vacuum. The proximal end is connected to the distal end by a first elongated tubular conduit for the vacuum to allow the vacuum to suck up the dirt and water into the mouth and convey such to the vacuum source for collection and disposal. A second elongated tubular conduit extends from the proximal end to the nozzle for conveying water from the high pressure water source when the activation mechanism is activated.

The above and other objects, features and advantages of the present invention should become even more readily apparent to those skilled in the art upon a reading of the following detailed description in conjunction with the drawings wherein there is shown and described illustrative embodiments of the invention.

DESCRIPTION OF THE DRAWINGS

In the following detailed description, reference will be made to the attached drawings in which.

DESCRIPTION OF THE PREFERRED EMBODIMENTS

Figure 1:
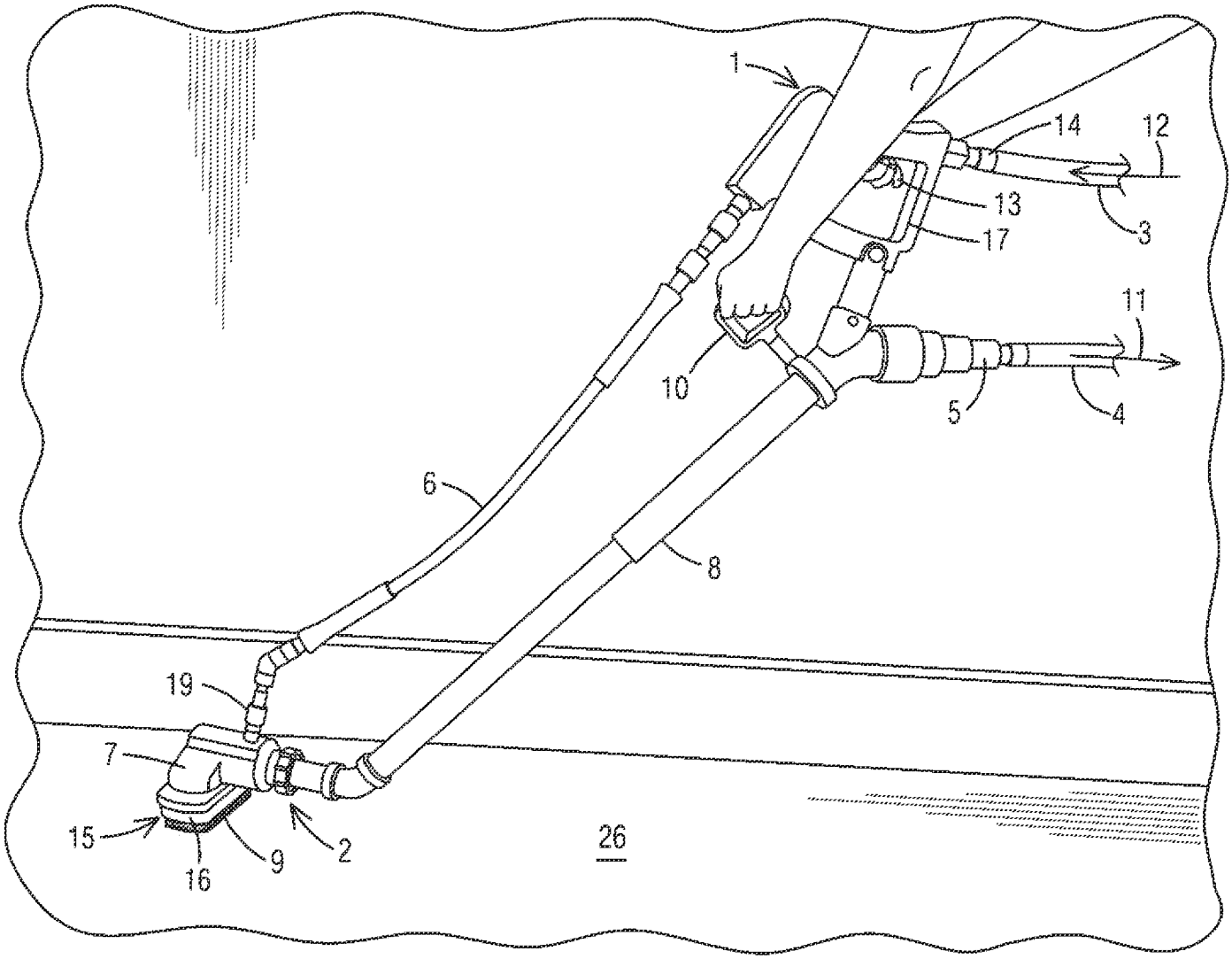
FIG. 1 is a perspective view of the grout and surface cleaning apparatus of the present invention in use cleaning a floor surface.
Figure 2:
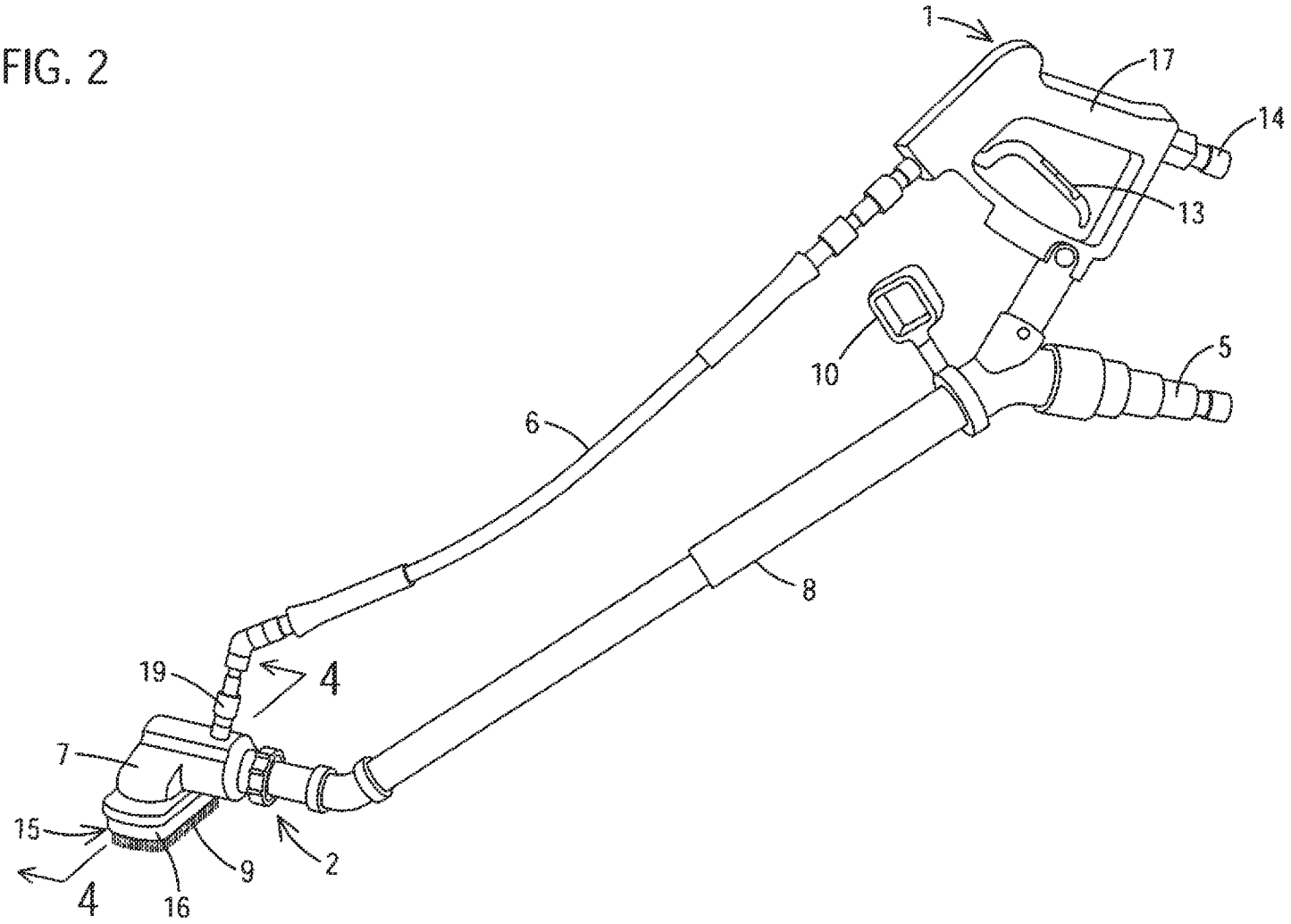
FIG. 2 is a side view of the grout and surface cleaning apparatus of the present invention.

For purposes of describing the preferred embodiment, the terminology used in reference to the numbered accessories in the drawings is as follows:

1. proximal end
2. distal end
3. high pressure water hose
4. vacuum hose
5. vacuum hose connector
6. high pressure water conduit
7. head
8. vacuum conduit
9. brushes
10. support handle
11. vacuum source
12. high pressure water source
13. trigger mechanism
14. high pressure water connector
15. mouth
16. barrier
17. activation handle
18. nozzle
19. high pressure water quick connection
20. water spray
21. inner brushes
22. outer brushes
23. perimeter of head
24. water suction orifices
25. mouth inlet
26. floor Discussing the preferred embodiments of the grout and surface cleaning apparatus of the present invention, reference is made to the drawings in FIGS. 1-5. FIG. 1 illustrates the cleaning apparatus as it would appear in use while cleaning a floor 26 and FIG. 2 illustrates a side view of the cleaning apparatus. The proximal end 1 has a handle 17 for holding the cleaner and activating a trigger 13 to allow water from a high pressure water source 12, such as a conventional pressure washer, to enter through hose 3 connected by male and female threads to a connector 14. The proximal end 1 also is connected to a vacuum source 11, which may be a conventional wet/dry vacuum, by a hose attached to a rigid or semi-rigid connector 5 which is preferably stepped or has sections having different circumferences to fit various sizes of vacuum hoses.

The proximal end 1 of the cleaning apparatus is connected to the cleaning distal end 2 by a rigid vacuum conduit 8 and a high pressure water conduit 6. The vacuum conduit 8 attaches to a side of the head and the high pressure conduit 6 attaches to a high pressure water quick connection 19 on a top of the head 7. The mouth 15 of the head can be surrounded by a flexible barrier 16 and a series of brushes 9 to prevent or deter water from being sprayed outside the perimeter of the head 7 so the water can be sucked up by the vacuum and conveyed to the vacuum source.

Figure 3:
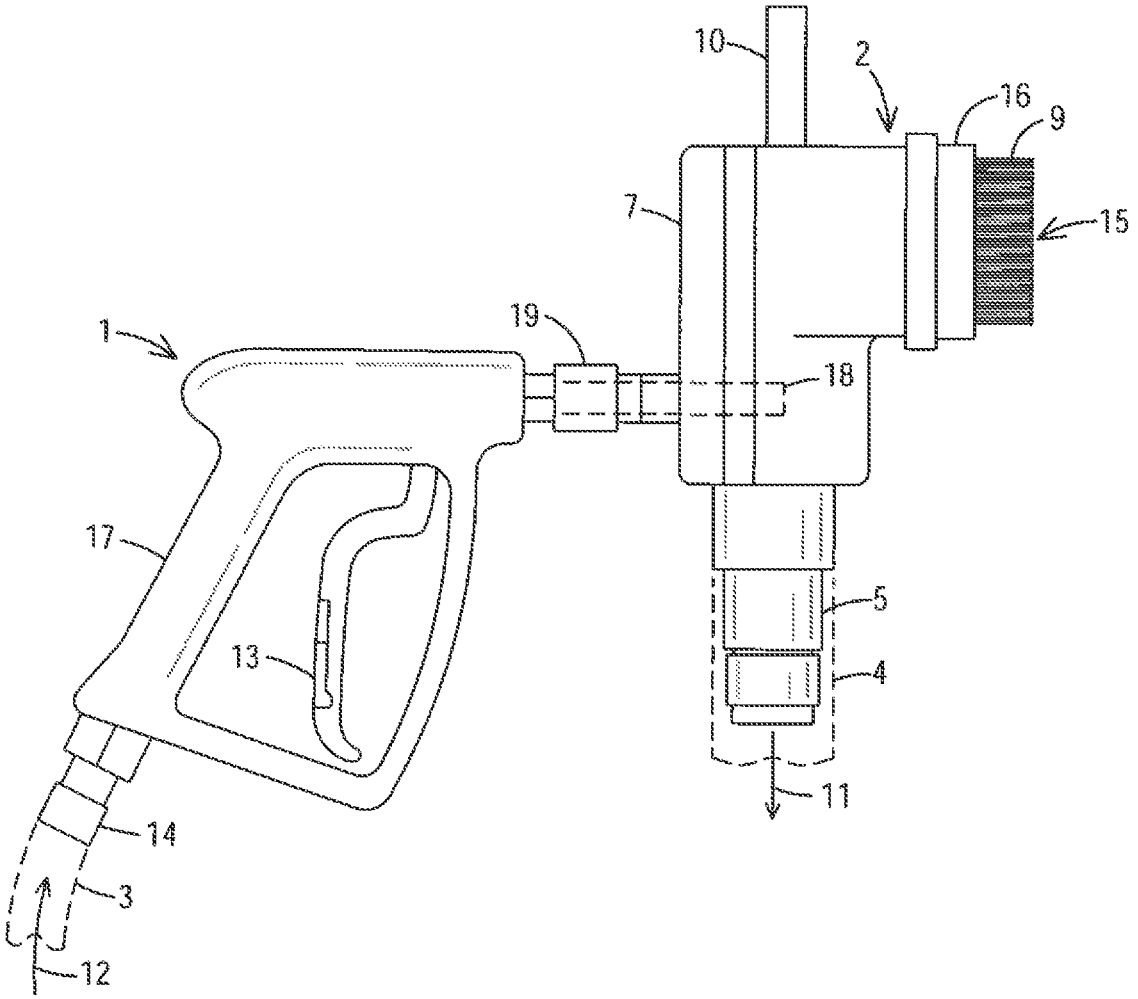
FIG. 3 is a side view of a hand-held surface cleaning apparatus of the present invention.

Referring to FIG. 3, a side view of a hand-held cleaning apparatus of the present invention that could be used for cleaning any flat surface is illustrated. The hand-held cleaning apparatus has the same components as the floor cleaning version illustrated in FIGS. 1 and 2, except for arrangement and location of some components, such as the high pressure water conduit 6 and vacuum conduit 8 are unnecessary as the activation handle 17 is directly connected to the nozzle 18 via a quick-connect high pressure water connection 19, as shown by dashed lines. Thus, the vacuum conduit 8 is removed from the head 7, the connector 5 is removed from the vacuum conduit 8 and the connector 5 is remounted onto the head 7 to achieve this hand-held conversion. Although the head 7 illustrated in FIG. 3 is angularly positioned for cleaning floors or other flat surfaces, the head 7 could be mounted at no angle on the vacuum conduit 8 or have a separate attachment for cleaning corners.

Figure 4:
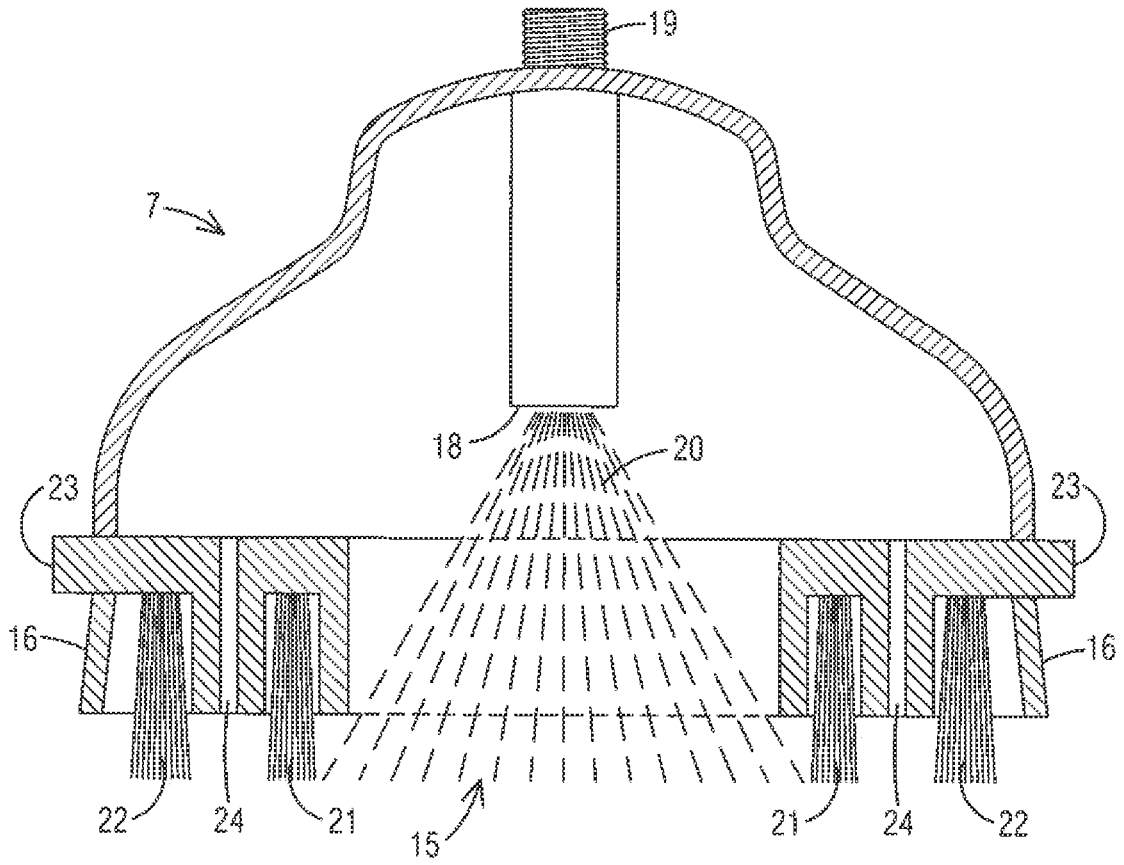
FIG. 4 is a cross sectional view along lines 4-4 of FIG. 2 of the head of the grout and surface cleaning apparatus of the present invention.

Referring to the FIG. 4, a cross sectional view along lines 4-4 of FIG. 2 of the head 7 of the invention is illustrated. In this view the high pressure water quick connection 19 is shown attached to the nozzle 18. The nozzle 18 may be changeable to vary the pressure and pattern of the water spray 20 hitting a surface being cleaned. The head 7 may have a series of brushes, such as an inner set 21 and outer brushes 22 of varying texture, or rubber, foam or combination thereof, to contain any water from escaping from the perimeter 23 of the head 7. Although brushes as illustrated may be preferred in forming a barrier rubber, foam or a combination thereof may be used to form a barrier against water splash. In addition, a flexible barrier 16 may also surround the perimeter of the mouth 15 to further reduce the likelihood of water escaping outside the perimeter 23 of the head 7.

Figure 5:
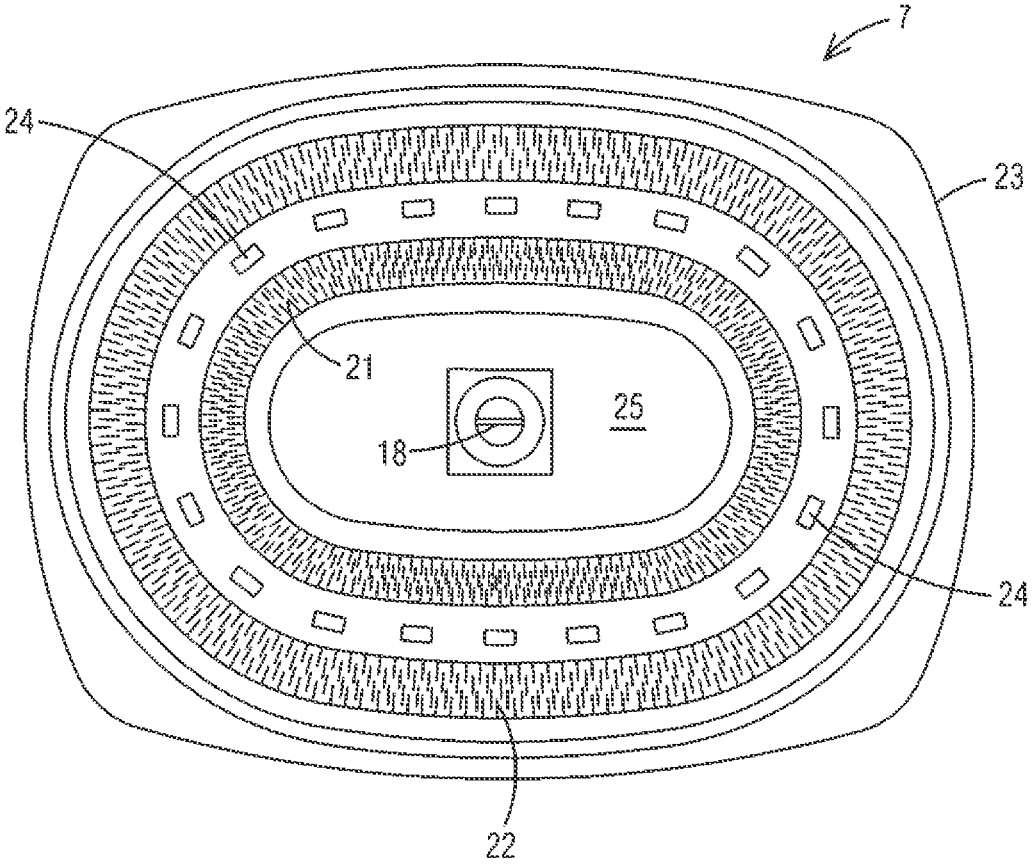
FIG. 5 is a bottom view of the head showing the mouth of the grout and surface cleaning apparatus of the present invention.

The final illustration of FIG. 5 illustrates the head 7 from the bottom showing the nozzle 18, inner brushes 21 and outer brushes 22 are arranged around the inlet of the mouth to prevent water from escaping outside the perimeter of the head 23. Orifices 24, which are shown as slots but could be of any shape, are shown between the inner brushes 21 and outer brushes 22 are included to allow the vacuum to suck up any water that may have escaped through the inner brushes 21.

It is to be understood that while a preferred embodiment of the invention is described, it is not to be limited to the specific form or arrangement of parts herein described and shown. It will be apparent to those skilled in the art that various changes may be made without departing from the scope of the invention and the invention is not to be considered limited to what is shown and described in the specification and/or drawings.

Having thus described my invention, I claim:

1. A grout and surface cleaning apparatus comprising: a head having a distal end, a proximal end, a top, and a mouth wherein a quick-connect water connection extending through the top of the head;

said quick-connect water connection being connectable to a handle connected to a pressure washer that provides a flow of water through the handle and the quick-connect water connection and a nozzle connected to the quick-connect water connection and extending into the head wherein water spray from the high pressure nozzle is directed through the open mouth of said head and onto a surface being cleaned;

a trigger connected to said handle allows the water spray from the nozzle to be activated and deactivated; said handle being oriented on the top of said head in a position that allows the trigger to be operated while still applying a downward pressure on the head and the surface being cleaned;

said proximal end of said head being connected to a vacuum hose;

an inlet located in the open mouth of said head that opens to the vacuum hose wherein water and dirt is sucked in through the open mouth of the head and the inlet and vacuum hose;

inner brushes arranged in the open mouth of the head around the inlet and the nozzle;

a plurality of orifices located inside the open mouth of the head wherein the plurality of orifices are separated from the inlet and the nozzle by the inner brushes; wherein suction is provided to the plurality of orifices by said vacuum hose to collect water and dirt that escapes said inner brushes;

outer brushes arranged around a perimeter of the open mouth wherein said plurality of orifices are located between said inner brushes and said outer brushes.

2. The grout and surface cleaning apparatus of claim 1 wherein:

said inner brushes and said outer brushes extend outside of the open mouth of the head.

3. The grout and surface cleaning apparatus of claim 1 wherein the head is connected to the vacuum hose via a connection having multiple stepped sections with different circumferences to allow for secure attachment to various sizes of vacuum hose from the vacuum source.

* * * * *